US008156578B2

(12) United States Patent
Bickmore et al.

(10) Patent No.: US 8,156,578 B2
(45) Date of Patent: Apr. 17, 2012

(54) RECIRCULATING WATER BATH TOY

(76) Inventors: Helen Bickmore, Albany, NY (US); Edwin L. Collins, Albany, NY (US)

( * ) Notice: Subject to any disclaimer, the term of this patent is extended or adjusted under 35 U.S.C. 154(b) by 405 days.

(21) Appl. No.: 12/554,070

(22) Filed: Sep. 4, 2009

(65) Prior Publication Data

US 2010/0015881 A1 Jan. 21, 2010

Related U.S. Application Data

(63) Continuation-in-part of application No. 11/325,662, filed on Jan. 4, 2006, now abandoned.

(60) Provisional application No. 60/641,350, filed on Jan. 4, 2005.

(51) Int. Cl.
*A47K 3/00* (2006.01)

(52) U.S. Cl. ..... 4/559

(58) Field of Classification Search ..... 4/559, 541.6
See application file for complete search history.

(56) References Cited

U.S. PATENT DOCUMENTS

| | | | | |
|---|---|---|---|---|
| 4,872,224 | A * | 10/1989 | Grimes et al. | 4/541.3 |
| 5,077,841 | A * | 1/1992 | Sugai | 4/541.4 |
| 5,172,433 | A * | 12/1992 | Lake | 4/541.4 |
| 6,401,273 | B1 * | 6/2002 | Fung et al. | 4/559 |
| 6,463,598 | B1 * | 10/2002 | David et al. | 4/591 |
| 6,663,458 | B1 * | 12/2003 | Jauregui | 446/73 |

* cited by examiner

*Primary Examiner* — Huyen Le
(74) *Attorney, Agent, or Firm* — Hiscock & Barclay, LLP

(57) ABSTRACT

The invention provides a water bath toy having a pump that draws water from a bath tub or pool and discharges the water back into the source. The pump is battery powered or hand powered. The invention includes a plurality of output options and a selector for choosing the active output feature, These features may include a narrow spray nozzle, a wide spray nozzle, a flexible hose, and a cascade with configurable obstructions that affect the water flow. The outer body of the water bath toy is configured to fit over the sidewall of a pool or bath tub.

14 Claims, 6 Drawing Sheets

Fig. 1
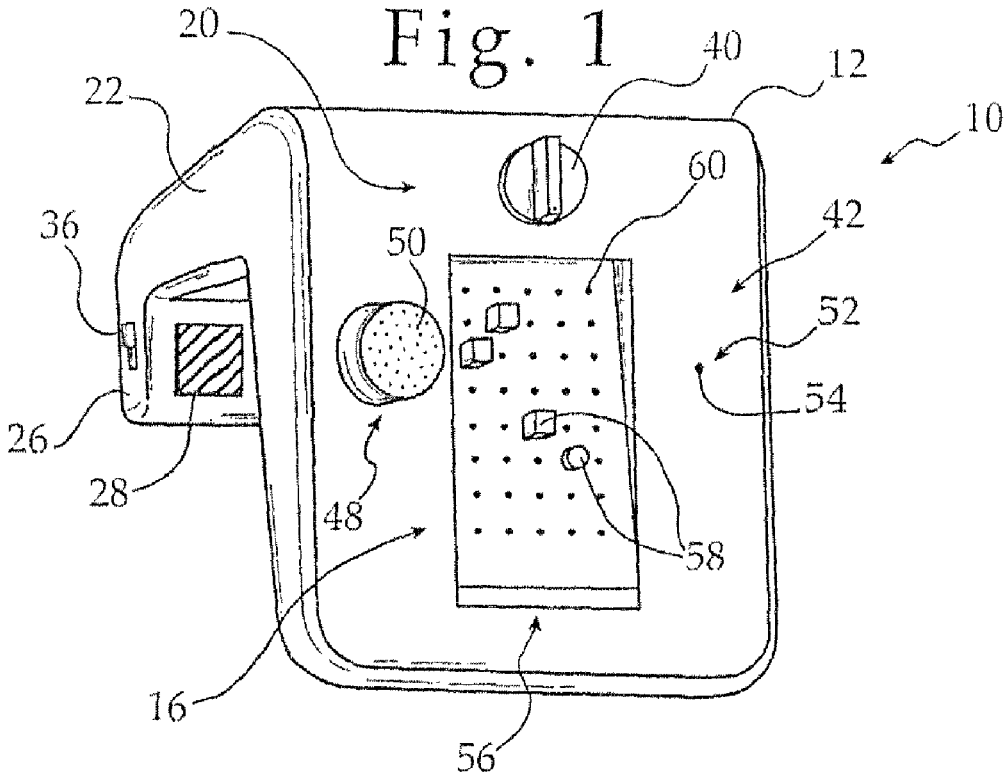
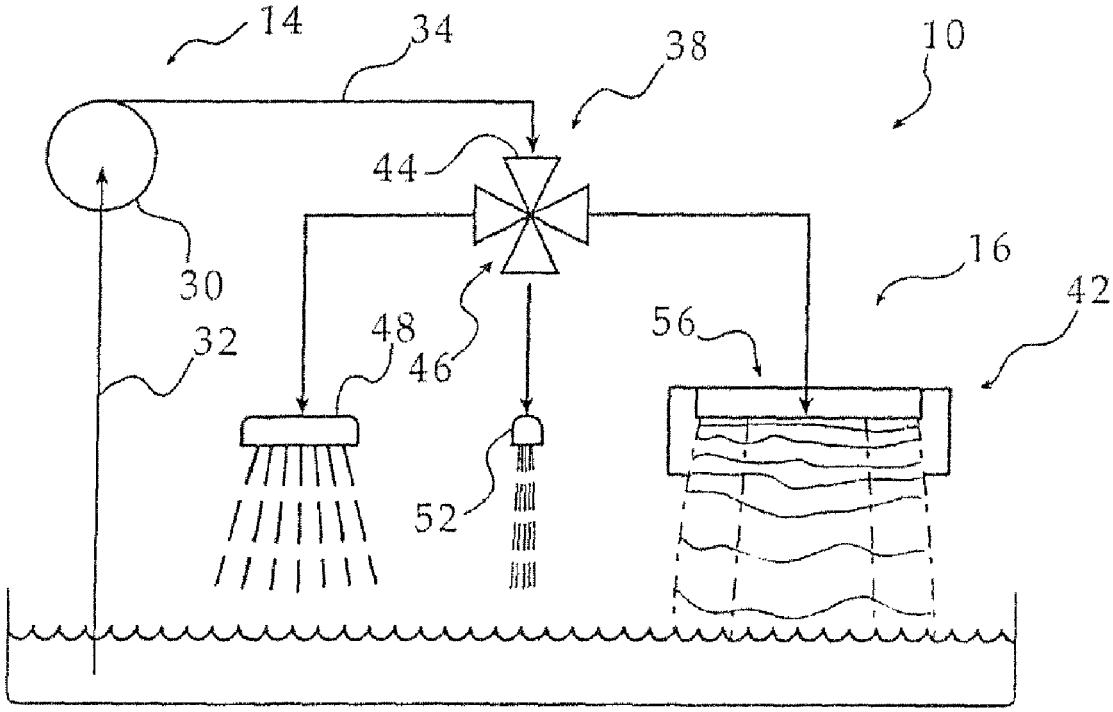
Fig. 2

RECIRCULATING WATER BATH TOY

CROSS-REFERENCE TO RELATED APPLICATIONS

This application is a continuation-in-part of co-pending application U.S. Ser. No. 11/325,662, filed Jan. 4, 2006 and also claims priority from U.S. Provisional Patent Application U.S. Ser. No. 60/641,350, filed Jan. 4, 2005. The content of the aforementioned applications is hereby incorporated by reference into this specification.

FIELD OF THE INVENTION

The invention relates to toys for children, especially those used in bathtubs and pools.

BACKGROUND OF THE INVENTION

Young children are often fascinated with running water. They see it running freely in streams, spraying out of the hose and discharging from the faucet into the kitchen sink and the bath tub. Playing with running water becomes an interesting curiosity for most children. However, playing with running water out of a faucet, whether in the sink or at bath time, can be wasteful, messy, and dangerous.

Currently, older children have the option of using outdoor water toys such as garden sprinklers and squirt guns. However, these options may not be available to particularly young children that require more direct supervision. Further, certain weather conditions, such as winter weather, may render such outdoor options unavailable.

Therefore, a means for children to explore their curiosity for running water in a controlled and safe manner is needed. Further, a means for children to explore their curiosity for running water while under direct supervision of an adult and that is not particularly dependent on outdoor weather conditions is desired.

SUMMARY OF THE INVENTION

The invention, therefore, provides a water bath toy for children to safely explore their curiosity for running water while under direct supervision of an adult. The invention provides a pump that draws water from a bath tub or pool and discharges the water back into the source above the water. The pump is battery powered or hand powered. The invention includes a plurality of output options above the water and a selector for choosing the active output feature. These features may include a narrow spray nozzle, a wide spray nozzle, a flexible hose, and a cascade with configurable obstructions that affect the water flow.

More particularly, the invention includes a recirculating water bath toy comprising a liquid intake port below the water and means for outletting the liquid above the water in fluid communication with the intake port. A selector valve that is in fluid communication with the intake port and the outletting means directs the liquid to one or more of the outletting means. An actuator engages the selector valve and is operable to cause the selector valve to direct the liquid to different outletting means. A pump is in fluid communication with the intake port and the selector valve. The water bath toy may include an outer body that is shaped to fit over a sidewall of a liquid reservoir, such as a bath tub or a pool. The outer body includes means for attaching to a sidewall of the liquid reservoir, such as a plurality of suction cups. The pump may be hand operated or battery operated, in which case, the batteries are housed in a compartment that is substantially waterproof. The outletting means may include a cascade having reconfigurable obstructions, a narrow spray nozzle, a wide spray nozzle, a flexible hose, or a combination thereof. A cover that comprises a graphical representation of cartoon characters, comic book characters, television personalities, or other forms that are pleasing to children may be fixably joined to the outer body. The graphical form may be incorporated into the outletting means.

An advantage of the present invention is that it provides a means for children to explore their curiosity for running water in a controlled and safe manner. Further, the present invention provides a water bath toy that may be used by a child under direct supervision by an adult. Even further, the present invention may be used indoors and thus is not particularly dependent on the outside weather.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein:

FIG. 1 is a front isometric view of the recirculating water bath toy of the present invention;

FIG. 2 is a schematic illustrating the general water flow in the water bath toy of FIG. 1;

Corresponding reference characters indicate corresponding parts throughout the several views. The example set out herein illustrates one embodiment of the invention but should not be construed as limiting the scope of the invention in any manner.

DESCRIPTION OF THE PREFERRED EMBODIMENTS

Figure 3:
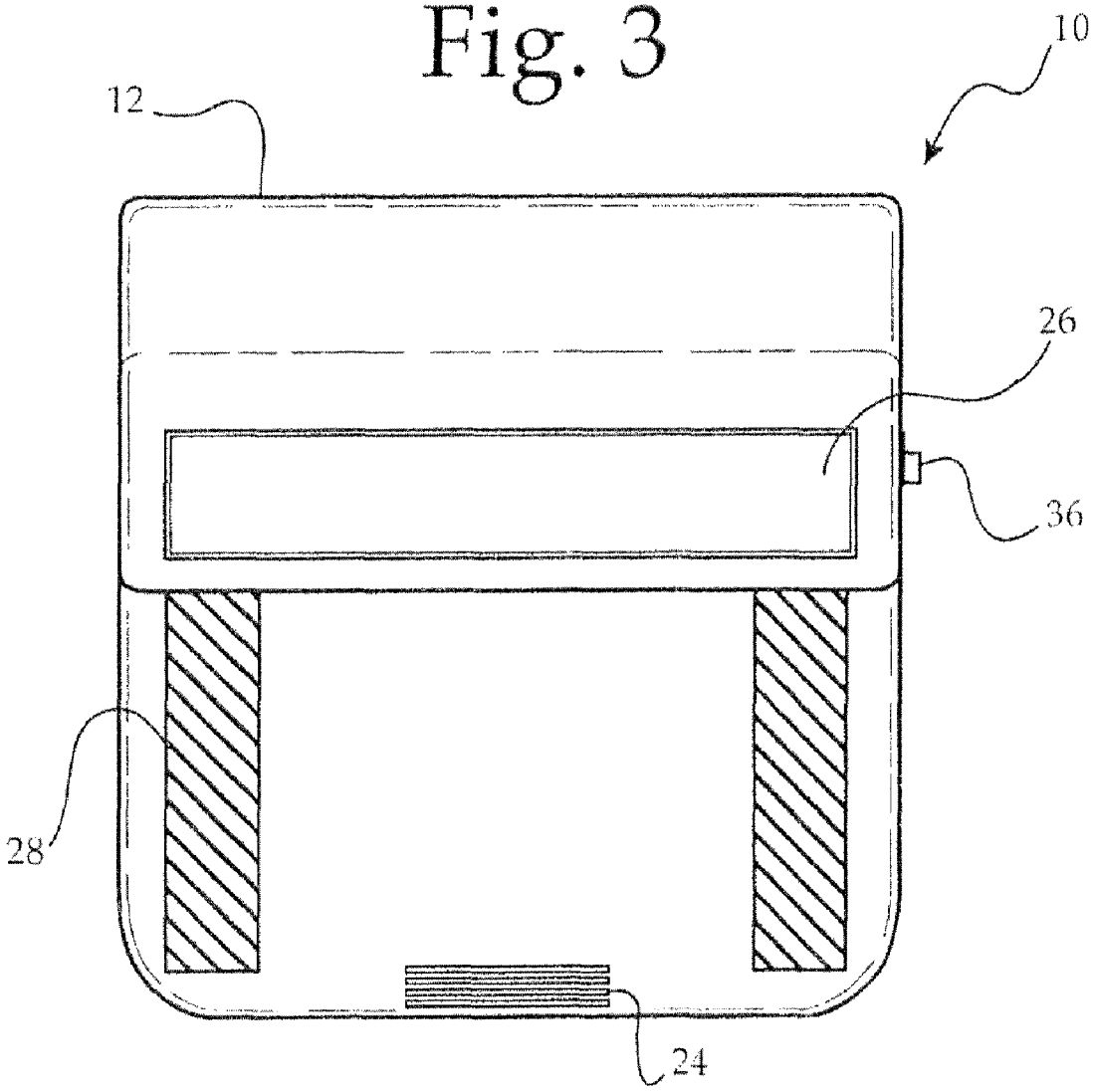
FIG. 3 is a rear view of the water bath toy of FIG. 1.

Referring now to the drawings, FIGS. 1 and 2 illustrate the recirculating water bath toy and an associated water flow schematic according to one embodiment of the present invention. The water bath toy 10 includes an outer body 12, a pump system 14, and an outlet system 16.

Figure 4:
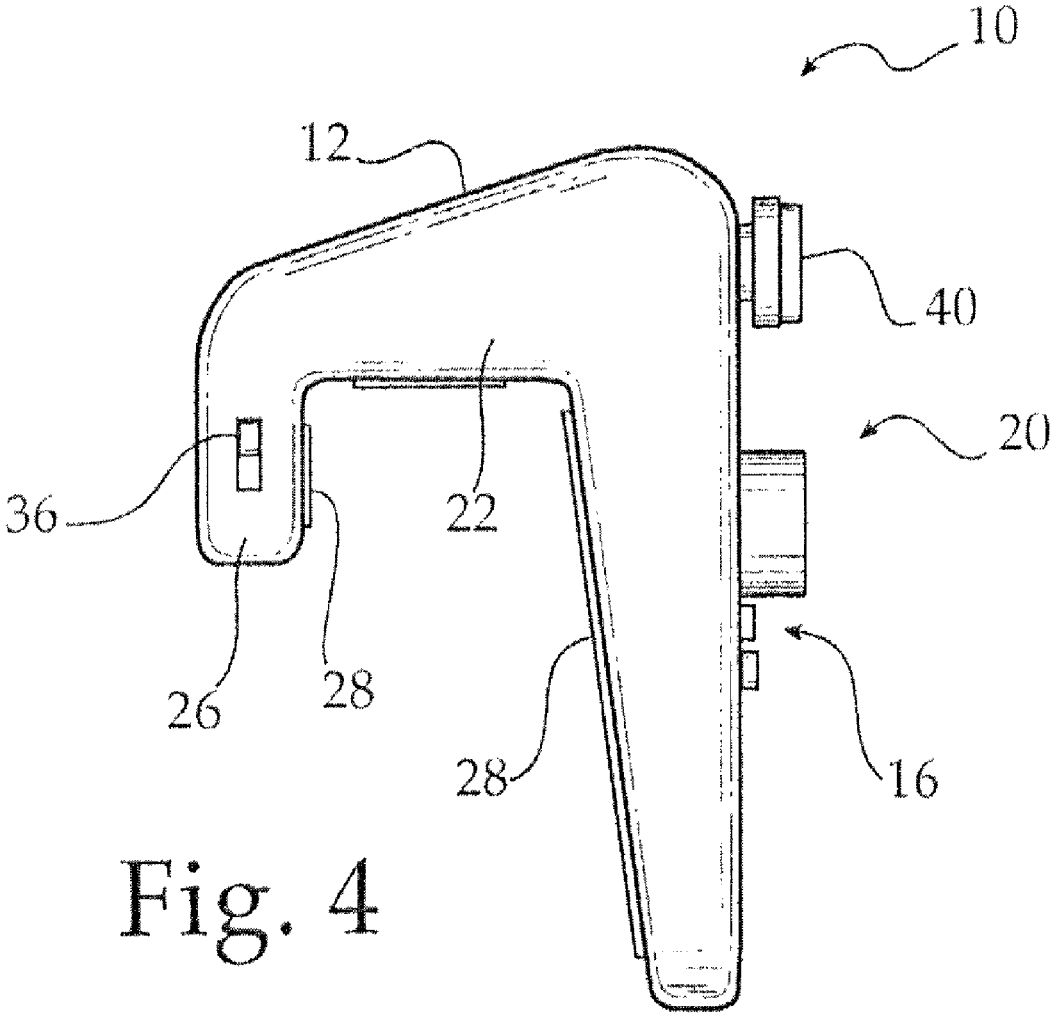
FIG. 4 is a side view of the water bath toy of FIG. 1.
Figure 7:
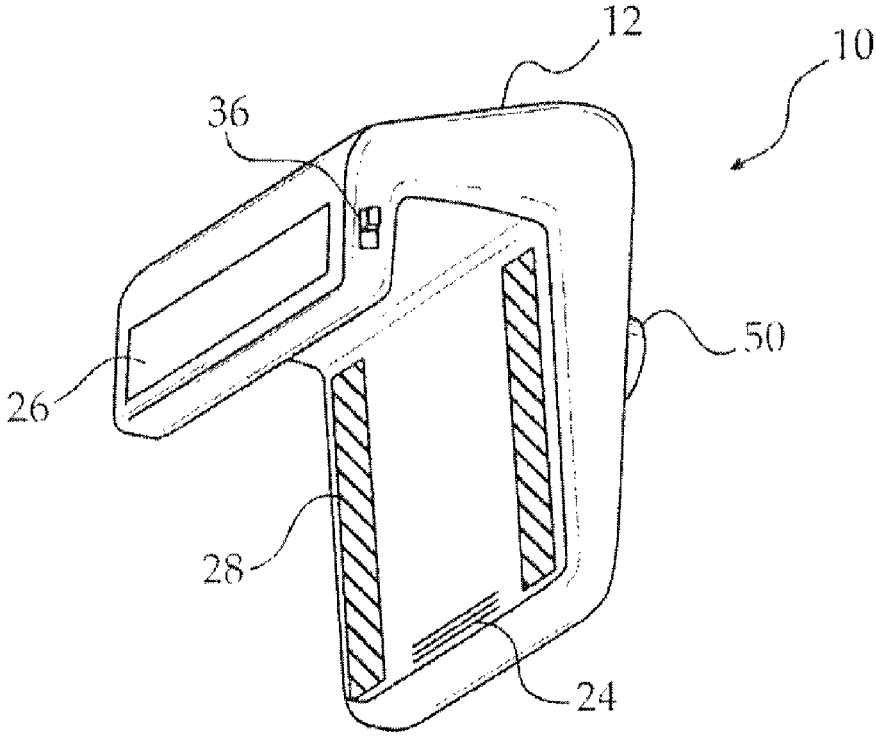
FIG. 7 is rear isometric view of the water bath toy of FIG. 1.

The outer body 12 includes an interface portion 20, a pump housing 22, a pump inlet 24 (FIG. 3), a battery compartment 26, and mounting means 28. The interface portion 20 houses the outlet system 16 including the associated controls. The pump inlet 24 is below the surface of the water and faces the wall of a bath tub or pool when the water bath toy 10 is properly installed. Thus the pump inlet 24 is not accessible to a child. The pump inlet 24 may include a screen or other means for preventing objects from being taken up into the pump inlet 24. The battery compartment 26 is best shown in FIGS. 3 and 7 and is a water resistant compartment in the present embodiment. FIG. 4 demonstrates that the shape of the outer body 12 is configured to fit over the wall of a bath tub or pool. The mounting means 28, shown in FIG. 1, aid in securing the outer body 12 to the wall of the bath tub or pool.

The mounting means 28 may be rubber pads, adhesive pads, suction cups, clamps, or any combination thereof.

Referring to FIG. 2, the pump system 14 includes a battery operated pump 30, a pump inlet line 32, and a pump outlet line 34, The pump 30 is powered by batteries in the battery compartment 26 via electrical wires. Alternatively, the pump 30 is a hand operated pump. The pump inlet line 32 facilitates fluid communication between the pump inlet 24 and the pump 30. The pump outlet line 34 facilitates fluid communication between the pump 30 and the outlet system 16. The pump system 14 further includes a power toggle switch 36 (FIG. 1) that penetrates the outer body 12. In the present embodiment the power toggle switch 36 is remotely located in relation to the interface portion 20 and the water.

Figure 5:
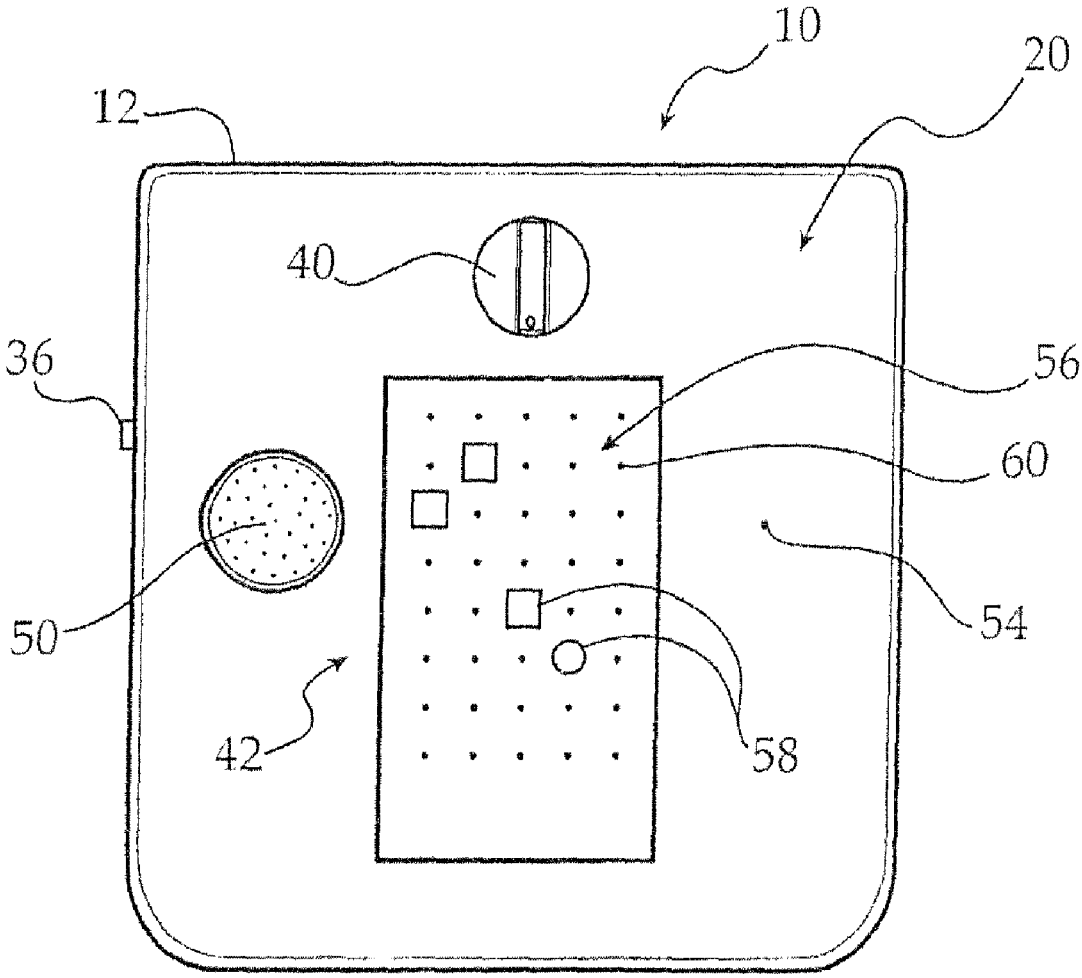
FIG. 5 is a front view of the water bath toy of FIG. 1.
Figure 6:
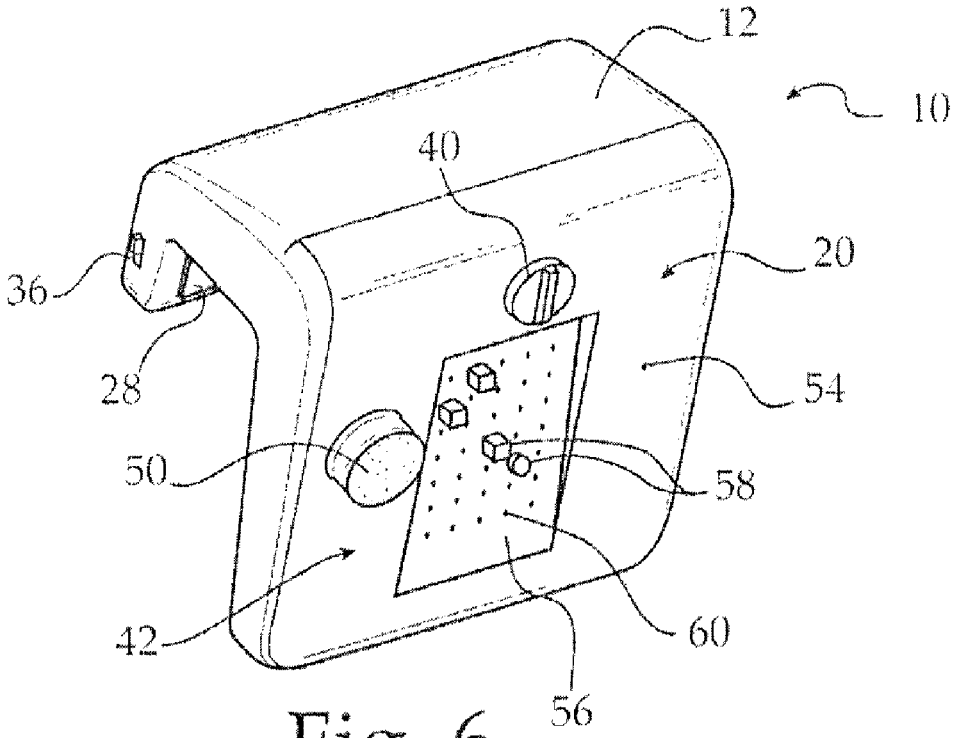
FIG. 6 is a second front isometric view of the water bath toy of FIG. 1.

Referring to FIGS. 2, 5, and 6, the outlet system 16 is shown to include a selector valve 38, a selector valve actuator knob 40, and a variety of output features 42. The selector valve 38 includes a valve inlet 44 in fluid communication with the pump outlet line 34 and a plurality of valve outputs 46 configured such that only one of the valve outputs 46 is open at any particular time. Each of the valve outputs 46 is in fluid communication with an output feature 42. The selector valve actuator knob 40 is operable to select which of the valve outputs 46 is open. In the present embodiment, the output features 42 include a wide spray feature 48 having a wide spray nozzle 50, a narrow spray feature 52 having a narrow spray nozzle 54, and a waterfall feature 56 having a variety of configurable obstructions 58. The output features 42 are disposed on the surface 64*a* of the front arm 64. The obstructions 58 engage support holes 60 and may be moved around to change the affect of the obstructions 58 on the water exiting the water bath toy 10 through the waterfall feature 56. Many further output features can be imagined that are within the scope of the invention, for example a directional hose-type outlet.

In use, the outer body 12 is mounted on a sidewall of a pool or a bath tub such that the mounting means 28 engages the sidewall. The distal end of front arm 64 of the outer body 12 is partially submerged in water such that the pump inlet 24 is at least partially submerged below water line 62 while outlet system 16 is disposed above water line 62. Such a configuration permits the child to observe the water flowing from outlet system 16. The back arm 66 is joined to the front arm 64 by connecting arm 68 that joints the arms at their respective ends. The water level 62 or the positioning of the outer body 12 may be adjusted to achieve this. A supervising parent activates the pump 30 by actuating the power toggle switch 36. FIG. 2 shows that the pump 30 draws water through the pump inlet line 32 and supplies pressurized water to the selector valve 38 via the pump outlet line 34. A child or supervising parent selects the output feature 42 by turning the selector valve actuator knob 40 to a corresponding position having an appropriate label on the face of the interface portion 20. The pressurized water travels through the selector valve 38 to the selected output feature 42. The selected output feature 42 in FIG. 1 is the waterfall feature 56. The user may arrange the obstructions 58 and observe the affect that different shapes and configurations have on the water flow in the waterfall feature. To ensure the safe use of the bath toy the pump is configured to delivery water at a predetermined rate. This predetermined rate is selected to cause the water to gently trickle out of the outlet feature 42 without substantial pressure. In one embodiment, the rate of water delivery is less than about 200 mL per second. In another embodiment, the rate of water delivery is less than about 100 mL per second. In yet another embodiment, the rate of water delivery is less than about 50 mL per second.

Figure 8:
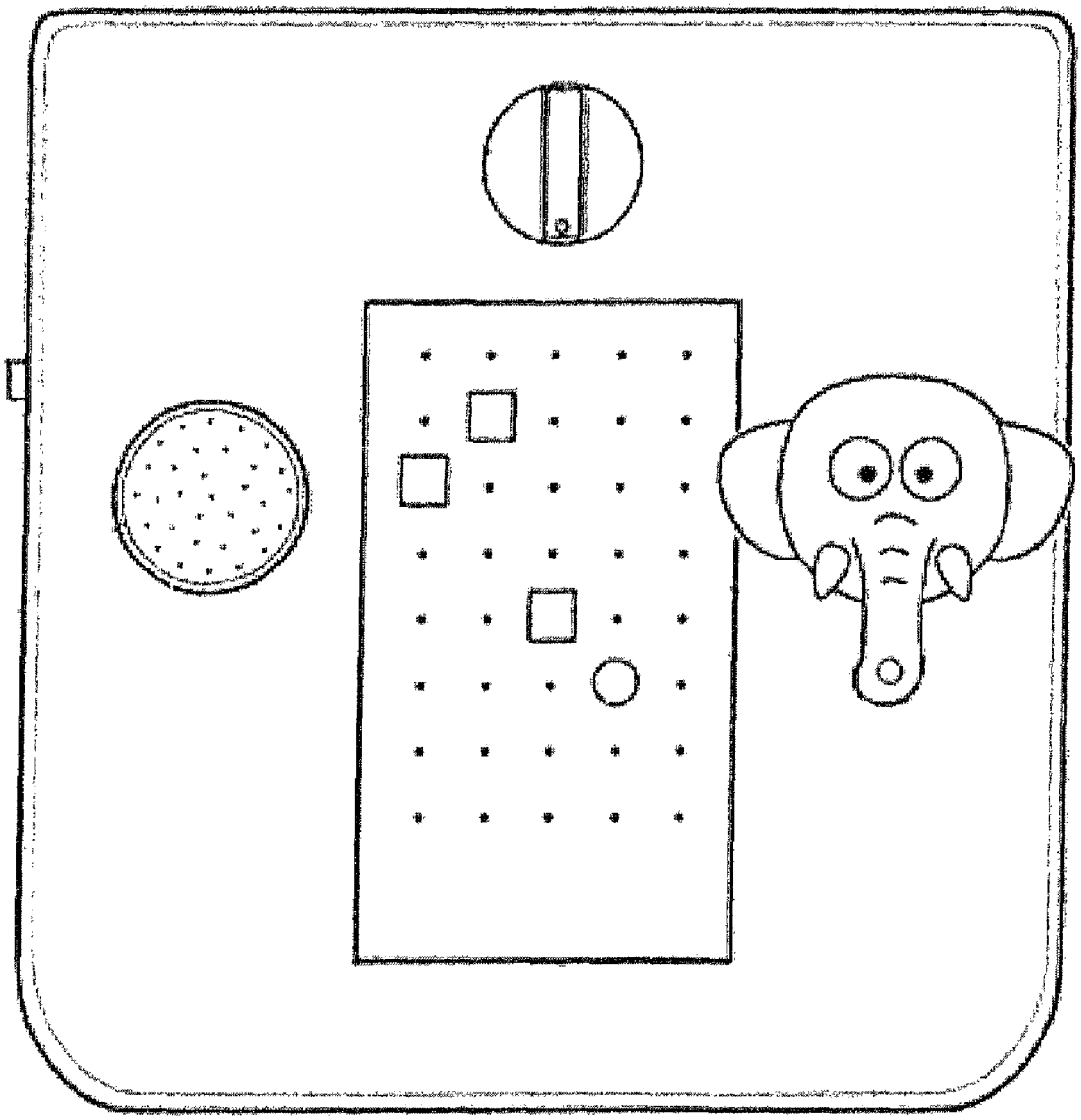
FIG. 8 is a front view with a cartoon figure attached to an outlet means.

Graphics that are pleasing to children, such as cartoon characters, comic book characters, and television personalities, may be included on the surface of the outer body 12. Further, pleasing shapes such as cartoon characters may be incorporated into the output features 42 such that the liquid appears to be emitted from the graphic. For example, the graphic may in the shape of an elephant and the water may appear to be emitted from the elephant's trunk. The graphic may be fixably joined to the outer body using any conventional technique including adhesives or making the graphic monolithic with respect to the outer body. For example, in FIG. 8, a graphic of an elephant head is disposed over spray nozzle 54 (see FIG. 5) such that water appears to be coming from a hole in the end of the elephant's trunk. In FIG. 8, the graphic is monolithic with the interface portion 20. In the present embodiment, durable and corrosion resistant materials such as high impact plastics and elastomers are used whenever possible.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed is:

1. A recirculating water bath toy, comprising:

an outer body being shaped to fit over a sidewall of a bathtub, the outer body having an elongated front arm with a proximal end and a distal end, a back arm with a proximal end and a connecting arm joining the front and back arms at the proximal ends of such arms;

a liquid intake port disposed at a distal end of the front arm such that, when the bath toy is in use, the intake port is below a waterline in the bathtub;

a plurality of means for outletting the liquid in fluid communication with said intake port, the plurality of means being disposed on a surface of the front arm and above the liquid intake port and waterline such that, when the bath toy is in use, the outletting means is disposed above the waterline in the bathtub;

a selector valve in fluid communication with said intake port and said outletting means, said selector valve directing the liquid to one or more of said outletting means;

an actuator engaging said selector valve and being operable to cause said selector valve to direct the liquid to different outletting means; and a pump in fluid communication with said intake port and said selector valve, the pump having a water delivery rate of less than about 100 mL per second.

2. The water bath toy of claim 1, the outer body further comprising means for attaching to the sidewall of the liquid reservoir.

3. The water bath toy of claim 2, wherein the attaching means is a plurality of suction cups.

4. The water bath toy of claim 1, wherein said pump is hand operated.

5. The water bath toy of claim 1, wherein said pump is battery operated.

6. The water bath toy of claim 5, wherein said batteries are housed in a compartment that is substantially waterproof.

7. The water bath toy of claim 2, wherein one of said outletting means is a cascade having reconfigurable obstructions.

8. The water bath toy of claim 1, wherein one of said outletting means comprises a narrow spray nozzle.

9. The water bath toy of claim 1, wherein one of said outletting means comprises a wide spray nozzle.

10. The water bath toy of claim 1, wherein one of said outletting means comprises a flexible hose.

11. The water bath toy of claim 1, wherein said toy further comprises a cover that is fixably joined to said outer body and that includes a graphic form.

12. The water bath toy of claim 11, the graphic form being selected from the group consisting essentially of cartoon characters, comic book characters, and television personalities.

13. The water bath toy of claim 11, the graphic form being monolithic with regard to said outletting means.

14. A recirculating water bath toy, comprising:

an outer body being shaped to fit over a sidewall of a bathtub, the outer body having an elongated front arm with a proximal end and a distal end, a back arm with a proximal end and a connecting arm joining the front and back arms at the proximal ends of such arms;

a liquid intake port disposed at a distal end of the front arm such that, when the bath toy is in use, the intake port is below a waterline in the bathtub;

a plurality of means for outletting the liquid in fluid communication with said intake port, the plurality of means being disposed on a surface of the front arm and above the liquid intake port and waterline such that, when the bath toy is in use, the outletting means is disposed above the waterline in the bathtub;

a selector valve in fluid communication with said intake port and said outletting means, said selector valve directing the liquid to one or more of said outletting means;

an actuator engaging said selector valve and being operable to cause said selector valve to direct the liquid to different outletting means; and a pump in fluid communication with said intake port and said selector valve, the pump having a water delivery rate of less than about 50 mL per second.

* * * * *